US005280214A

United States Patent [19]

Johnson

[11] Patent Number: 5,280,214

[45] Date of Patent: Jan. 18, 1994

[54] SPARK PLUG WITH A GROUND ELECTRODE CONCENTRICALLY DISPOSED TO A CENTRAL ELECTRODE

[75] Inventor: James E. Johnson, Clearwater, Fla.

[73] Assignee: Ultra Performance International, Inc., Clearwater, Fla.

[21] Appl. No.: 20,099

[22] Filed: Feb. 19, 1993

Related U.S. Application Data

[63] Continuation of Ser. No. 644,993, Jan. 23, 1991, abandoned, which is a continuation-in-part of Ser. No. 421,172, Oct. 13, 1989, abandoned.

[51] Int. Cl.[5] ..... H01T 13/32

[52] U.S. Cl. ..... 313/139; 313/141

[58] Field of Search ..... 313/139-143; 123/169 EL

[56] References Cited

U.S. PATENT DOCUMENTS

| | | | |
|---|---|---|---|
| 2,048,481 | 7/1936 | Arnois | 313/139 |
| 2,299,924 | 10/1942 | Ost | 313/139 |
| 2,487,535 | 11/1949 | Fernandez | 123/169 |
| 2,894,162 | 7/1959 | Ignatjev | 313/141 |
| 3,970,885 | 7/1976 | Kasima | 313/141 |
| 4,023,058 | 5/1977 | Lara et al. | 313/141 |
| 4,268,774 | 5/1981 | Forkum, Jr. | 313/141 |
| 4,670,684 | 6/1987 | Kagawa et al. | 313/142 |
| 4,916,354 | 4/1990 | Forkum, Jr. | 313/141 |

FOREIGN PATENT DOCUMENTS 0167687 1/1986 European Pat. Off. .

OTHER PUBLICATIONS

Hot Rod, Feb. 1990, pp. 81-84, Marlan Davis, entitled "Fire In The Hole".

*Primary Examiner*—Donald J. Yusko
*Assistant Examiner*—Michael Horabik
*Attorney, Agent, or Firm*—Herbert W. Larson

[57] ABSTRACT

A spark plug for an internal combustion engine wherein a ring shaped ground electrode has a uniform annular hole with an internal diameter about 0.80 to 1.25 the outer diameter of the center electrode. The ground electrode is vertically spaced below the center electrode and is concentric therewith. The ground electrode is connected to one or more mounting posts attached to a spark plug metal housing. The spark from the center electrode to the ground electrode has multiple paths and results in a spark plug which improves fuel combustion, increases gasoline mileage and engine horsepower and significantly reduces the smolder or ignition delay time and environmental pollutants such as oxides of nitrogen, carbon monoxide and hydrocarbons.

15 Claims, 4 Drawing Sheets

SPARK PLUG WITH A GROUND ELECTRODE CONCENTRICALLY DISPOSED TO A CENTRAL ELECTRODE

This application is a continuation of application Ser. No. 07/644,993, filed Jan. 23, 1991, now "abandoned", which is a continuation-in-part of application Ser. No. 07/421,172, filed Oct. 13, 1989, now "abandoned".

FIELD OF THE INVENTION

This invention relates to spark plugs used in internal combustion engines. More particularly, it refers to an improved spark plug having a ground electrode with a ring or ring segment internal opening concentrically disposed with respect to a center electrode.

DESCRIPTION OF THE PRIOR ART

Commercial internal combustion engine spark plugs in current wide spread use have characteristicly had a center electrode with an exposed end in its base that is spaced apart from a ground electrode. The ground electrode is usually an L shaped single arm welded to an edge of the plug and bent over towards the center electrode at substantially a right angle. Although these plugs work satisfactorily, it has been determined that their design substantially detracts from a complete burn cycle in an internal combustion engine's combustion chamber. This results in the overheating of plug parts, incomplete combustion and the production of oxides of nitrogen in the combustion chamber.

Attempts at improving plug firing and achieving a more complete combustion chamber burn has received little research effort compared to other methods of reducing oxides of nitrogen automotive emissions. U.S. Pat. No. 2,487,535 describes an annular tapered curved fork as a spark plug ground electrode for the purpose of "conducting excessive heat away". Column 1, lines 50–51. The central electrode terminates in a position on a plane with the ground electrode so that the spark is substantially perpendicular to the longitudinal axis of the spark plug. Such a spark geometry does not provide for a large surface area to promote active combustion.

U.S. Pat. Nos. 2,874,162 and 4,268,774 describe ground electrodes having diverging prongs. Such a configuration increases the spark surface area and improves combustion chamber burning. However, substantial further improvement in burning efficiency in the combustion chamber due to spark generation could be made.

SUMMARY OF THE INVENTION

I have invented a spark plug with an improved ground electrode which greatly reduces ignition delay time and, even under high compression, generates significantly increased spark between the ground electrode and central electrode to thereby increase burning efficiency in the combustion chamber and result in increased engine horse power and mileage per liter of fuel consumed, reduced oxides of nitrogen and hydrocarbon emissions and provides extended spark plug performance.

As used hereinafter, the term "ring shaped" ground electrode includes such ground electrodes having an open inner annular uniform circumference from about 270 to 360 degrees and the diameter of the opening being about 0.80 to 1.25 times the outer diameter of a central electrode with which it is concentrically disposed. The outer shape of the ground electrode may be annular, square, rectangular, oblong or other geometric configuration.

My invention is the discovery that a ring shaped ground electrode mounted to at least one mounting post by way of a mounting ring, or directly welded, crimped or otherwise electrically attached to a spark plug housing, produces multiple spark arcs around the inner surface of the ground electrode from the central electrode. The preferred embodiment of my ring shaped electrode has an interior uniform diameter ranging from about one to about one and one tenth the exterior diameter of the central electrode and is concentric or co-axial with the central electrode. Most preferred is an interior diamter of about 0.015 of an inch larger than the exterior diameter of the central electrode. The terminal end of the central electrode is typically vertically spaced about 0.030 to 0.060 inch or 0.76 to 1.52 mm from a bottom surface of the ground electrode to define a spark gap. The low angle multiple sparks produced by my ring shaped electrode greatly reduces smolder, or ignition delay time and results in a more complete fuel burning in the combustion chamber to thereby increase engine horse power and mileage per liter of fuel consumed, together with a reduction of oxides of nitrogen and hydrocarbon emissions from the engine exhaust system. The spark pattern is maintained even under very high compression where other spark plugs cease all except sporadic firing.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
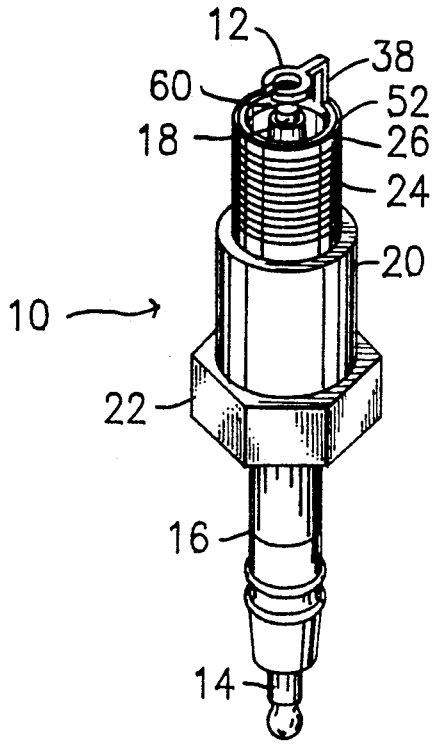
FIG. 1 is an isometric view of a ring shaped ground electrode in the spark plug of this invention where the ring is open.

Throughout the following detailed description, the same reference numerals refer to the same elements in all figures. The spark plug has been shown in a base-up position in the drawings for ease of description. However, the base is considered in its usual lower position for purposes of the description that follows.

Spark plug 10 shown in FIG. 1 is a conventional internal combustion engine spark plug except for the ring shaped ground electrode 12 substituted for the L shaped ground electrode typically seen in conventional spark plugs. The spark plug 10 shown in FIG. 1 has a terminal element 14 connected to a coil wire (not shown). A high quality insulator such as a ceramic material 16 encapsulates a central electrode which terminates at the bottom of the spark plug 10 as exposed central electrode 18 in the form of a solid cylinder. The ceramic material could be substituted with a high temperature resistant copolymer. The bottom portion of the spark plug 10 has a metal shell 20 and a nut portion 22. The shell 20 terminates in a shank 24 which has a shank skirt 26. The interior portion of the shank 24 is in the shape of a cup 28. The center electrode 18 is located in the center of the cup 28. In addition, the interior surface of the shank skirt 26 has an inwardly protruding annular shelf 30.

The ring shaped ground electrode 12 of my invention has an annular open center and is supported by one to four mounting posts 38. The ring 12 can have a gap 36 up to 90° or be closed 12A as shown in FIGS. 13–23. The gap 36 can exceed 90°, but the spark pattern decreases in proportion to the increase in the gap. Mounting posts 38 are attached at a first end 40 to a right angled beam 31 or a slanted member 32 and at a second end 42 to a mounting ring 44.

The inside diameter of the ring shaped ground electrode 12 is uniform around the ring and ranges from 0.80 to 1.25 times the diameter of the center electrode 18. In addition, the inner circumference of the ground electrode 12 is concentric with respect to center electrode 18.

Figure 6:
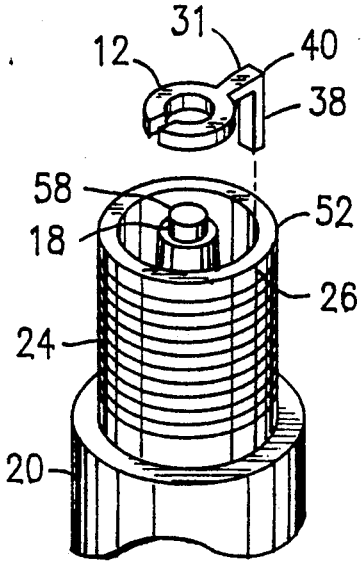
FIG. 6 is an exploded view of an alternate ground electrode component in relation to a spark plug cup.
Figure 7:
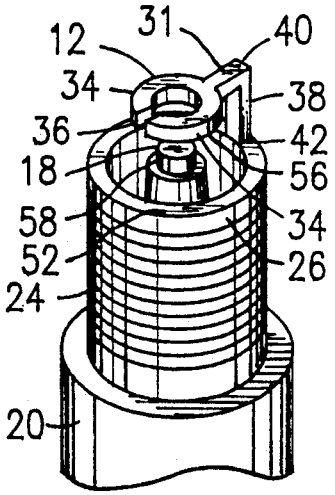
FIG. 7 is an isometric view of the ground electrode component of FIG. 6 welded in place.
Figure 8:
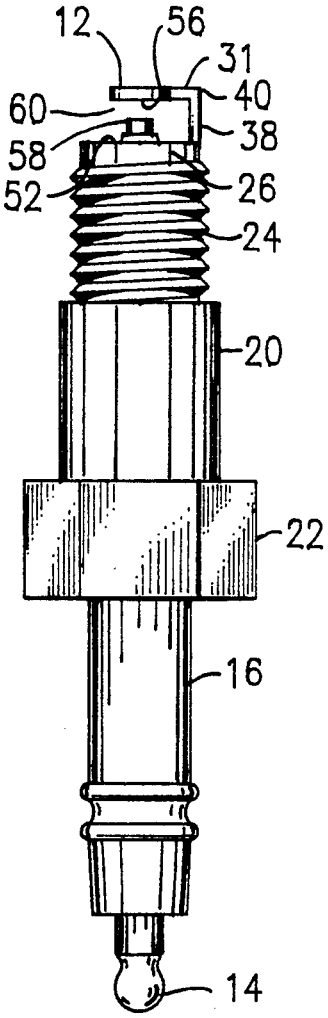
FIG. 8 is an elevation view of the spark plug of the invention.
Figure 9:
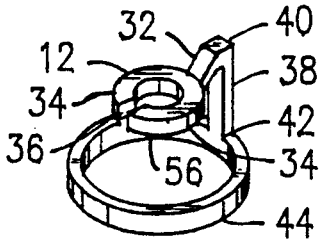
FIG. 9 is an isometric view of an embodiment of the ground electrode with a ring base.
Figure 11:
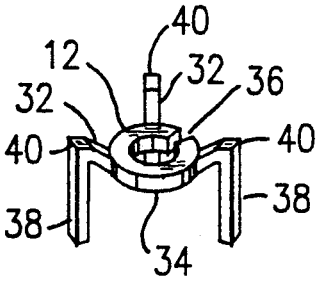
FIG. 11 is an isometric view of the ground electrode of FIG. 9 with three support arms instead of the ring base.
Figure 12:
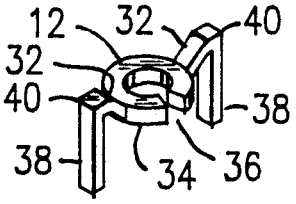
FIG. 12 is an isometric view of the ground electrode of FIG. 9 with two support arms instead of the ring base.
Figure 13:
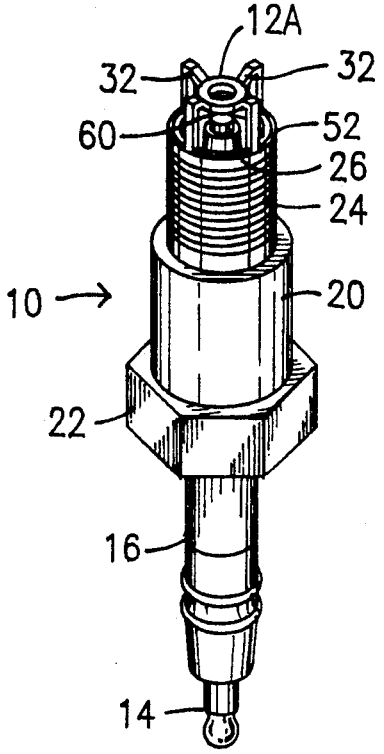
FIG. 13 is an isometric view of an alternative embodiment of a ring shaped ground electrode in the spark plug of this invention.
Figure 18:
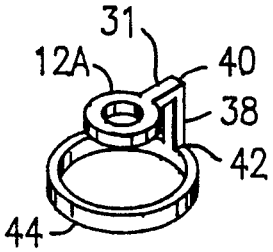
FIG. 18 is an isometric view of an embodiment of the ring shaped ground electrode component.
Figure 21:
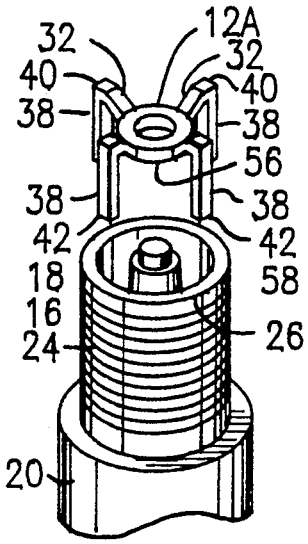
FIG. 21 is an exploded view of one embodiment of the ring shaped ground electrode component without a mounting ring shown in relation to a spark plug cup.
Figure 19:
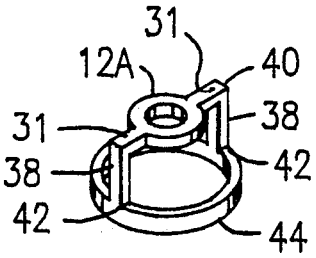
FIG. 19 is an isometric view of another embodiment of the ring shaped ground electrode component.
Figure 20:
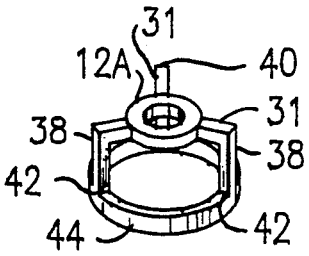
FIG. 20 is an isometric view of yet another embodiment of the ring shaped ground electrode component.
Figure 22:
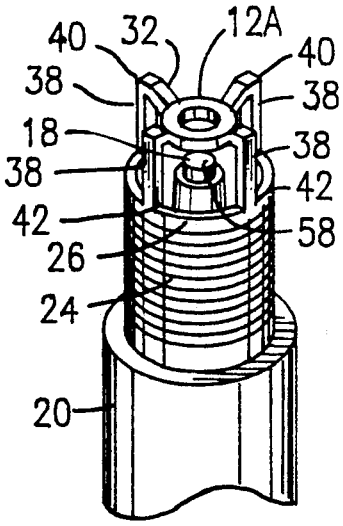
FIG. 22 is an isometric view of the ring shaped ground electrode component of FIG. 21 welded to the spark plug metal skirt.
Figure 23:
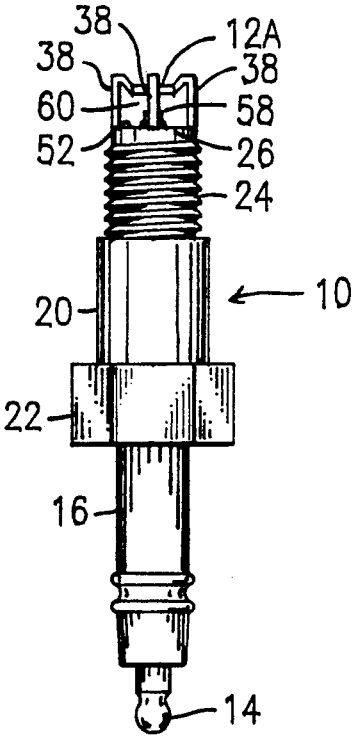
FIG. 23 is a side elevation view of the ground electrode of FIG. 20 brazed to a spark plug.

Beam 31 or slanted member 32 connect the first end or bottom 40 of mounting post 38 to the ring shaped ground electrode 12. In the case of slanted member 32 the ring 12 is on a plane higher than the bottom 40 of each mounting post 38. In the case of beam 31 there is a sharp right angle with respect to post 38 so the ring 12 is on the same plane with the bottom 40 of each mounting post 38. A single post 38 as seen in the embodiment of FIGS. 6 and 18, double posts 38 as seen in FIGS. 12 and 19, triple posts 38 as seen in FIGS. 11 and 20, or four posts 38 as seen in FIGS. 13–17 and 21–22 can be used to support the ring electrode 12 or 12A.

In constructing the spark plug 10 of my invention the ground electrode component 46 or 46A consisting of the mounting ring 44, the mounting post 38 and the ring shaped electrode 12 or 12A is preferably cast from a high quality metal such as a nickel/chromium alloy, platinum alloy or the like. Conventional welding, brazing or other fusion of the support post 38 to the housing can be employed in place of the use of a mounting ring.

Figure 2:
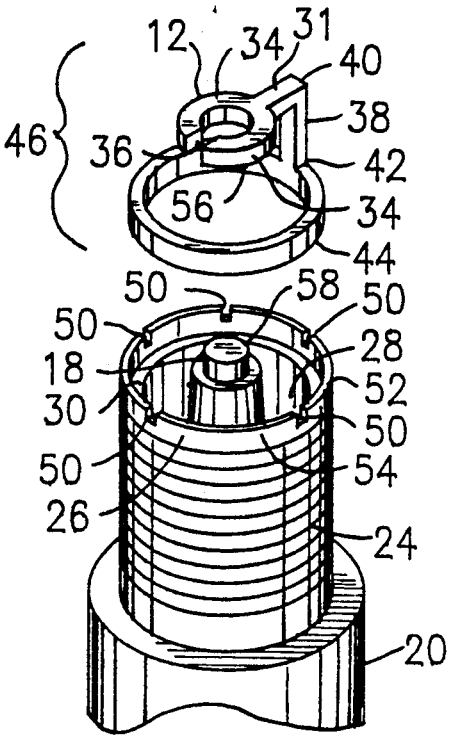
FIG. 2 is an exploded view of the ground electrode component in relation to the bottom of the spark plug.
Figure 3:
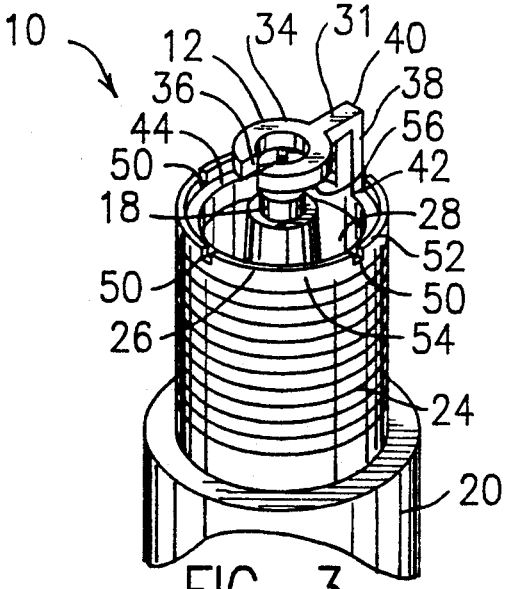
FIG. 3 is an isometric view of the ground electrode mounted within a spark plug cup.
Figure 4:
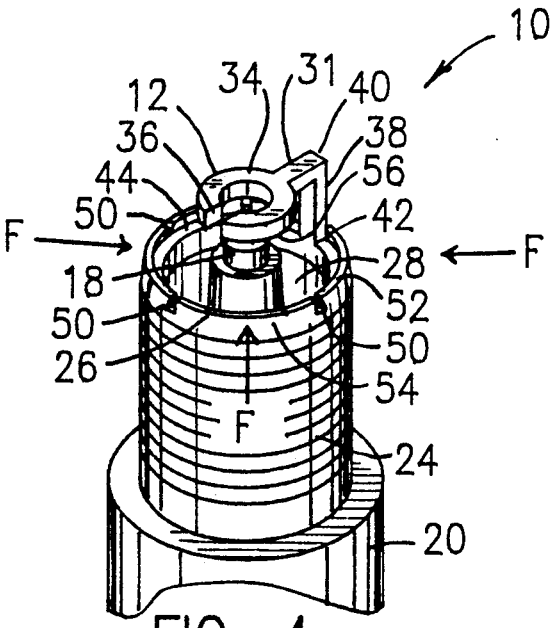
FIG. 4 is an isometric view of the ground electrode in the spark plug cup showing a method of locking the ground electrode in place.
Figure 5:
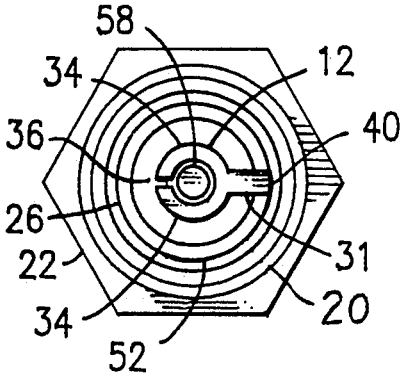
FIG. 5 is a bottom plan view of the spark plug.
Figure 14:
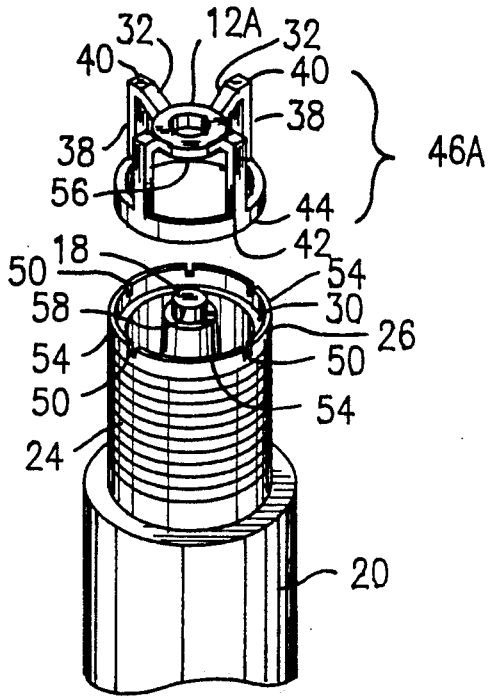
FIG. 14 is an exploded view of the ring shaped ground electrode component of FIG. 13 in relation to the bottom of the spark plug.
Figure 15:
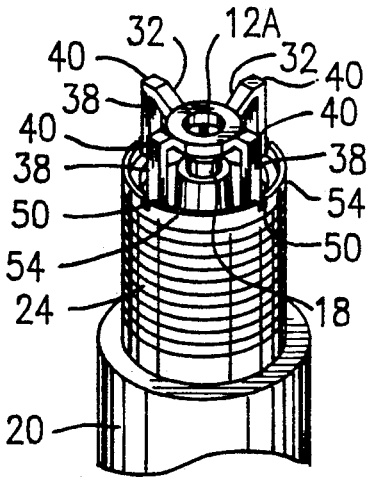
FIG. 15 is an isometric view of the ring shaped ground electrode of FIG. 13 mounted within a spark plug cup.
Figure 16:
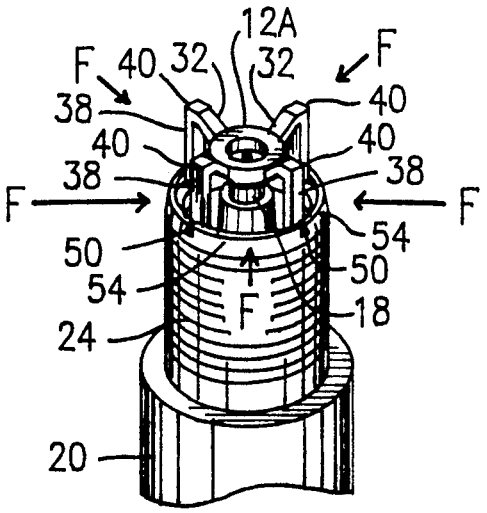
FIG. 16 is an isometric view of the same ring shaped ground electrode of FIG. 15 in the spark plug cup showing a method of locking the ground electrode in place.
Figure 17:
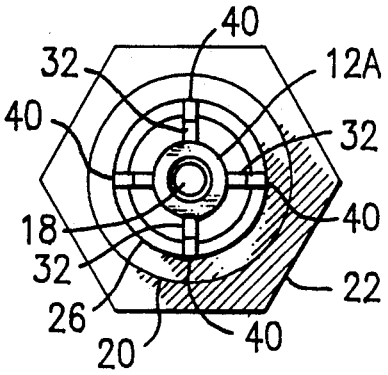
FIG. 17 is a bottom plan view of the same spark plug as shown in FIGS. 13–16.

The ground electrode component 46 or 46A is placed on top of shelf 30 as shown in FIGS. 2 and 14 respectively with the spark plug 10 in an inverted position. Vertical notches 50 are cut in the edge 52 of shank skirt 26. The metal sections 54 between notches 50 are bent or crimped as shown by force arrow F in FIGS. 4 and 16, over the mounting ring 44 to insure a fixed mounting position of the component 46 within the cup 28 of the spark plug 10.

The distance 60 between the ground electrode 12 or 12A top surface 56 and the bottom surface 58 of center electrode 18 typically is about 0.030 to 0.060 inch or 0.76 to 1.52 mm. See FIGS. 1, 8, 13 and 23. Greater or lesser spacing may be required for combustion chambers of unusual design or fuels substituted for gasoline such as propane, methanol or ethanol.

Upon firing, the electrical spark moves from the center electrode 18 to and along the top surface 56 of electrode 12 or 12A. The angle of the spark from electrode 18 to the top surface 56 of electrode 12 or 12A is less than 30 degrees and preferably is less than fifteen degrees from the longitudinal axis of the spark plug.

The ring shaped ground electrode 12 or 12A of my invention generates an enhanced spark pattern which significantly increases the performance and efficiency of internal combustion engines and reduces the smolder, or ignition delay time to result in more complete combustion of the fuel mixture, thereby improving the combustion flame spread around the periphery of the ground electrode. Such a uniform flame spread produces up to twenty percent added horsepower for a given amount of fuel consumed and approximately three to six miles per gallon increased fuel economy. In addition, there is a reduction of twenty-five to thirty-five percent in hydro-carbons and a significant reduction in carbon monoxide, and oxides of nitrogen in the exhaust gasses. As a further advantage, and of great significance, the ignition delay time, or combustion chamber smolder time, is reduced by more than 50% and the spark plug life is at least doubled over a conventional spark plug since the distribution of the spark along surface 56 prevents the single point type burn which occurs on a conventional ground electrode. In addition, the present configuration continues to fire in substantially the same firing pattern at very high compression where other spark plugs cease all but sporadic firing.

By casting the electrode component 46 or 46A, greater variability in the metal usage can be achieved to obtain the optimum longevity of the ground electrode 12. Alternatively, the electrode component 46 or 46A can be stamped or ground from a piece of suitable electrode metal. The electrode component 46 or 46A is placed on shelf 30 and the metal sections 54 are bent over to crimp the mounting ring 44 and thereby hold the electrode component 46 in place. If the mounting ring 44 is not employed, then each mounting post 38 may be fused or otherwise connected to edge 52 as is well known in the art.

Figure 10:
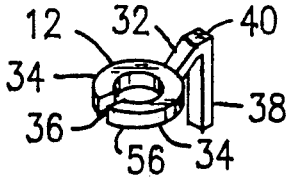
FIG. 10 is an isometric view of the ground electrode of FIG. 9 without the ring base.

An alternative embodiment of my invention is shown in FIGS. 10, 11 and 12 wherein the mounting ring 44 is not used and the ground electrode 12, integral with mounting posts 38, is welded or otherwise connected to the edge 52 of a spark plug skirt 26 at the second end 42.

In the ring shaped ground electrode 12 shown in FIGS. 1–12 the discontinuity or gap 36 in the ring is less than 90° between arms 34. Preferably, the gap is about 0.015 to 0.098 inch or 0.38 to 2.5 mm and the ends of the arms 34 forming gap 36 are parallel to each other.

The effectiveness of the preferred spark plug of this invention in reducing hydrocarbon and oxides of nitrogen emissions from automobile exhausts is on a similar level to that achieved by properly working catalytic converters presently used on automobiles.

The improved spark plug of this invention can be used in conventional internal combustion engines for automobiles, boats, airplanes, lawn mowers and like articles of manufacture. It also improves horsepower in dual plug cylinders and in combustion chambers with enhanced turbulence.

I claim:

1. In an internal combustion engine spark plug having a metal housing at least partially enclosing an insulator containing a conductive center electrode, the center electrode having a bottom portion in the form of a solid cylinder with a planar surface at an end distal from the insulator, the center electrode extending from the insulator at a bottom end of the spark plug, the bottom end of the center electrode being vertically spaced by at least 0.015 inches from a ground electrode attached to the metal housing, the improvement wherein the ground electrode has a ring shaped firing portion attached to the metal housing by at least one integral mounting post, a top of the ring shaped firing portion of the ground electrode being fixed at a distance from and parallel to the bottom planar surface of the center electrode, an inner annular uniform circumference of the ground electrode being concentric with the center electrode, the ground electrode inner diameter ranging from 0.80 up to 1.25 times an outer diameter of the center electrode, and a firing pattern from the center electrode forming an annular ring pattern around the top of the ground electrode firing portion.

2. The spark plug according to claim 1 wherein the ring shaped ground electrode and the at least one integral mounting post are integral with a mounting ring, the mounting ring being in a plane parallel to the ring shaped ground electrode and vertically spaced by at least one mounting post.

3. The spark plug according to claim 2, wherein the metal housing has a shank skirt at the lower end crimped over the mounting ring to hold the ground electrode in position.

4. The spark plug according to claim 1 wherein at least one mounting post is brazed to the metal housing at an end distal from the ring shaped ground electrode.

5. The spark plug according to claim 1 wherein the insulator is a ceramic material.

6. The spark plug according to claim 1 wherein an integral slanted member connects an edge of the ring shaped ground electrode to the bottom of the at lest one integral mounting post so that the ring shaped ground electrode is on a plane nearer to the center electrode than the bottom of the at least one mounting post.

7. The spark plug according to claim 1 wherein the ring shape of the ground electrode has a discontinuity of up to 90°.

8. The spark plug according to claim 7 wherein the ground electrode is supported by one mounting post and the discontinuity is located at a point distal from the post.

9. The spark plug according to claim 1 wherein the inner diameter of the ring shaped ground electrode is from 1 to 1.1 times the outer diameter of the center electrode.

10. The spark plug according to claim 1 wherein the inner diameter of the ring shaped ground electrode is 0.015 inches more than the outer diameter of the center electrode.

11. The spark plug according to claim 1 wherein there are three mounting posts.

12. The spark plug according to claim 1 wherein there are four mounting posts.

13. A metal ground electrode component for use in spark plugs comprising a ring with a uniform internal diameter integral with a slanted member or beam connecting the ring to a first end of a mounting post, a second end of the mounting post connecting to a mounting ring parallel to and vertically spaced from said ring.

14. The ground electrode component according to claim 13 wherein the metal comprises a nickel/-chromium alloy.

15. The ground electrode component according to claim 13 wherein the metal comprises a platinum alloy.

* * * * *